United States Patent [19]

Klusmier et al.

[11] Patent Number: 4,949,546

[45] Date of Patent: Aug. 21, 1990

[54] COMPACT HEAT EXCHANGER FOR A CRYOGENIC REFRIGERATOR

[75] Inventors: Lawrence A. Klusmier, Chelmsford; Allen J. Bartlett, Milford; Dale A. Dopson, Dorchester, all of Mass.

[73] Assignee: Helix Technology Corporation, Waltham, Mass.

[21] Appl. No.: 270,660

[22] Filed: Nov. 14, 1988

[51] Int. Cl.[5] ..... F25B 39/02

[52] U.S. Cl. ..... 62/6; 62/515; 165/174

[58] Field of Search ..... 62/6, 84, 468, 515; 165/174

[56] References Cited

U.S. PATENT DOCUMENTS

| | | | |
|---|---|---|---|
| 1,816,159 | 7/1931 | Smith | 165/174 |
| 2,905,447 | 9/1959 | Huet | 165/174 |
| 3,318,375 | 5/1967 | Linder | 165/174 |
| 4,693,736 | 9/1987 | Klusmier | 62/468 |
| 4,799,359 | 1/1989 | Nicoll | 62/468 |

FOREIGN PATENT DOCUMENTS

| | | | |
|---|---|---|---|
| 149251 | 2/1936 | Austria | 165/174 |

OTHER PUBLICATIONS

Heat Transfer, Inc.; Sunstrand ® Sales Pamphlet.
Sphere Matrix ® Sales Pamphlet; Vapor Corporation; Heat Exchange Products.
Noranda Sales Pamphlet.

*Primary Examiner*—Ronald C. Capossela
*Attorney, Agent, or Firm*—Hamilton, Brook, Smith & Reynolds

[57] ABSTRACT

A heat exchanger has a set of tubes through which fluid pass. In thermal communication with these tubes are fins of high thermal conductivity material which disperse the heat contained within the fluid. Also useful in dispersing the heat contained within the passing fluid are rods inserted within the tubes to substantially decrease the hydraulic diameter of the tubes. This heat exchanger may be used in a cryogenic refrigeration system which also includes a compressor for compressing refrigerant gas, a separator for separating refrigerant gas and oil used by the compressor, and a cryogenic refrigerator for expanding the refrigerant gas.

20 Claims, 3 Drawing Sheets

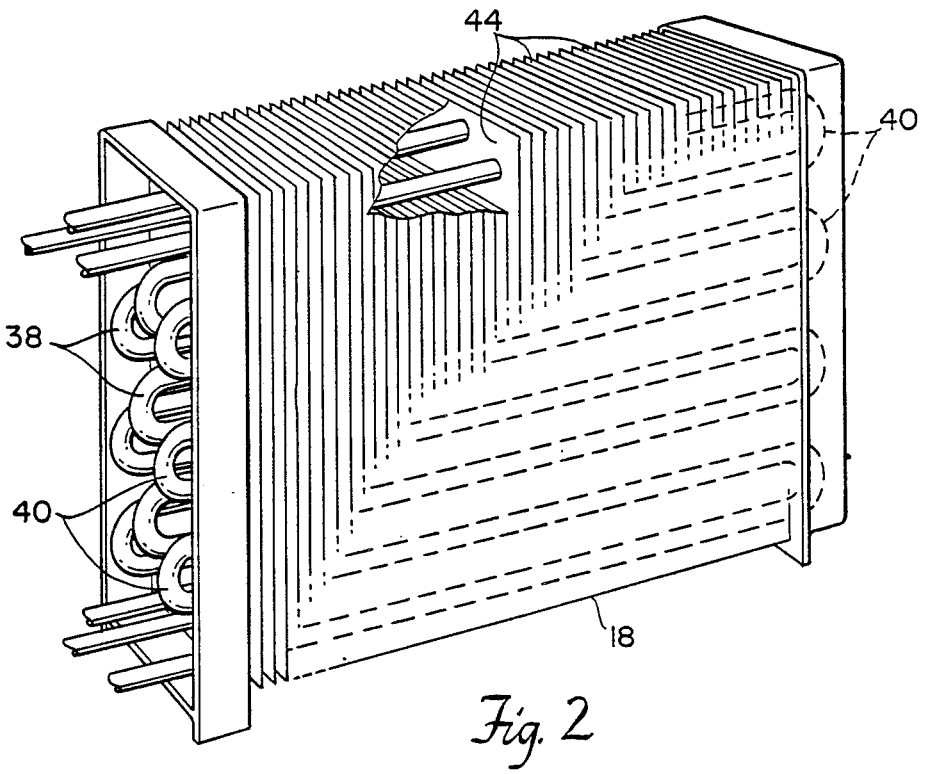
Fig. 2
Fig. 3
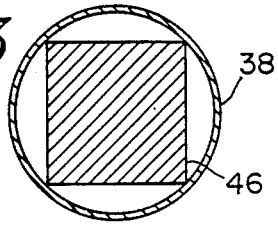
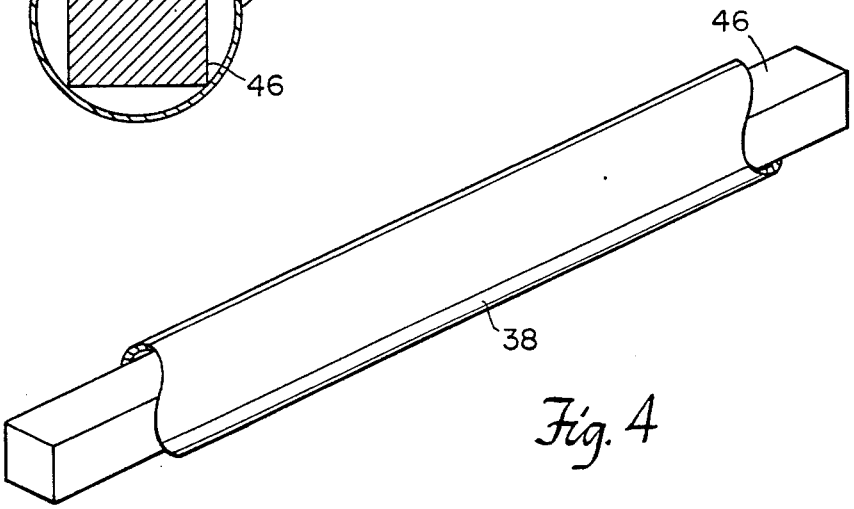
Fig. 4

COMPACT HEAT EXCHANGER FOR A CRYOGENIC REFRIGERATOR

BACKGROUND OF THE INVENTION

This invention pertains generally to the cooling of refrigerant gas and oil used in a cryogenic refrigeration system. The cryogenic refrigeration system contains a compressor pump which compresses a mixture of oil and refrigerant gas. The purpose of the oil is to absorb heat produced in compressing the refrigerant gas and to provide lubrication to the compressor pump. The heat produced during compression is generally dispersed through heat exchangers external to the compressor. There are two separate fluid flows that need to be cooled: an oil and gas mixture flow and a liquid oil flow. In conventional systems, the different flow characteristics of the two dictate the need for separate heat exchangers containing different fin/tube arrangements.

The oil and gas mixture from the heat exchanger is separated into its two component parts. The oil component, along with the output from the liquid oil heat exchanger returns to the input of the compressor pump. On the other hand, the gas component is cleaned in an adsorber and directed to the cold head of a cryogenic refrigerator such as a Gifford-MacMahon cryogenic refrigerator disclosed in U.S. Pat. No. 3,218,815 to Chellis et al. After traveling through the refrigerator, the gas is returned to the compressor through a return line and mixed with returned oil to start the entire process again.

DISCLOSURE OF THE INVENTION

A heat exchanger contains a set of tubes for carrying fluids. Rods are contained within the tubes so as to substantially decrease the hydraulic diameter thereof. Preferably, these rods extend a substantial length of the tubes. Likewise, it is preferable that they are metallic and have a polygonal cross-section. It is especially preferable that the rods decrease the hydraulic diameter of the tubes to less than 50% of that of the tubes without such rods.

In the application of the invention, a cryogenic refrigeration system utilizes a compressor to compress a mixture of refrigerant gas and oil. The compressor is housed in an oil sump which also serves to partially separate oil from the refrigerant gas. The refrigerant gas and oil mixture as well as the liquid oil are cooled using an external heat exchanger. After leaving the heat exchanger, the refrigerant gas is cleaned and flows to a cryogenic refrigerator where it is expanded. It, subsequently, returns to the compressor. The oil, after leaving the heat exchanger, is filtered and, likewise, returns to the compressor to be mixed with the gas.

There are preferably three rows of tubes within the heat exchanger which are coupled to form a serpentine flow path. It is further preferable that the middle row of tubes is staggered with respect to the other rows. When three rows are used, two adjacent rows through which the liquid oil flows contain inserted rods. The third row contains no rods and is reserved for the refrigerant gas and oil mixture.

Surrounding the tubes are fins of high thermal conductivity material in thermal communication with the tubes. These fins preferably are a stack of parallel plates containing holes so as to allow the tubes to pass through each plate at the same respective position on each plate.

BRIEF DESCRIPTION OF THE DRAWINGS

The foregoing and other objects, features and advantages of the invention will be apparent from the following more particular description of a preferred embodiment of the invention, as illustrated in the accompanying drawings in which like reference characters refer to the same parts throughout the different views. The drawings are not necessarily to scale, emphasis instead being placed upon illustrating the principles of the invention.

FIG. 2 is a perspective view, partially broken away, of the heat exchanger of FIG. 1.

FIG. 3 is a cross-sectional view of a rod and a tube in the heat exchanger of FIG. 2.

FIG. 4 is a perspective view, partially broken away, of the rod and tube as seen in FIG. 3.

DETAILED DESCRIPTION

Figure 1:
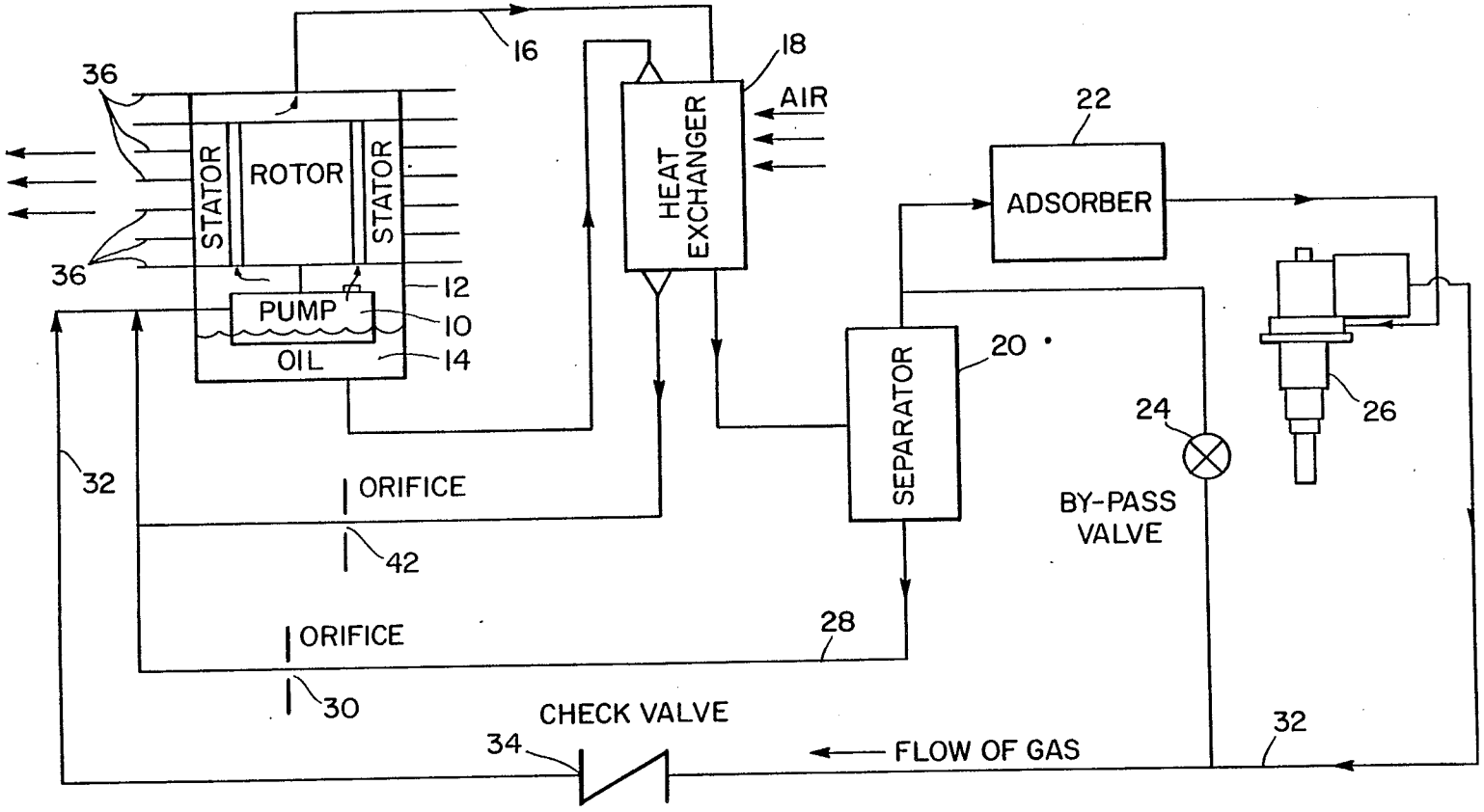
FIG. 1 is a schematic illustration of a cryogenic refrigeration system embodying the invention.

The present invention relates to a cryogenic refrigeration system. A schematic illustration of such a system is shown in FIG. 1. A mixture of refrigerant gas and oil is drawn into the compressor pump 10 wherein the mixture is compressed. The compressed gas and oil is then exhausted into a compressor housing 12 which surrounds the compressor pump 10. As the compressed mixture is exhausted from the pump 10 into the housing 12, the bulk of the oil separates from the compressed gas and collects in an oil sump 14. Hence, the housing 12 acts as a first separator. Next, the compressed gas and oil mixture is fed through a feed line 16 which carries the mixture to the heat exchanger 18 for cooling. After exiting the heat exchanger 18, the gas may be further filtered for oil by an oil separator 20 and an adsorber 22. Oil separated by the oil separator 20 may be returned to the pump 10 through a suction line 28. The oil must pass through an orifice 30 on its way back to the pump 10.

A bypass valve 24 connected between the oil separator 20 and adsorber 22 acts as a bleed to maintain the proper pressure differential across a cryogenic refrigerator 26. The compressed gas that exits the adsorber 22 is fed into the cryogenic refrigerator 26. Once the gas has performed work in the refrigerator 26, it is returned to the pump via a return line 32. A check valve 34 may be placed along the return line to prevent the flow of gas from flowing back to the refrigerator 26.

During the operation of the refrigeration system, a considerable amount of heat is generated by the pump 10. In order to maintain operating efficiency and prolong the life of the pump, the compressor must be cooled. As illustrated by the present invention, oil in the sump 14 is cooled by circulating it through the external heat exchanger 18. Additionally, a series of fins 36 may be pressed to the compressor housing 12 to act as heat exchangers.

The heat exchanger as shown in FIG. 2 has several parallel rows of tubes 38, 40. Preferably there are three rows; and the rows are staggered so as to allow maximum heat dispersal. The hot oil from the sump 14 is directed into two adjacent rows 38, whereas the gas and oil mixture is directed to the other row 40. The oil flow exits the two adjacent rows 38 after traversing a preferably serpentine path within the heat exchanger 18, and is returned to the sump 14 through an orifice 42. The serpentine shape maximizes the length of the flow path while minimizing the area occupied by the tubes. All of the rows of the tubes 38, 40 are surrounded by fins 44 of high thermal conductivity material in thermal communication with the tubes. It is preferable that the fins 44 are a stack of plates which maximize heat transfer. Each plate contains holes through which the tubes tightly fit. Suction created by the pump 10 serves as the mechanism to pump the oil through the heat exchanger 18 as well as from the separator 20 and to pump gas from the refrigerator 26.

The two adjacent rows 38 of the heat exchanger 18 contain rods 46 that extend a substantial length of the tubes as shown in FIG. 4. The relative position of the rods 46 within the tubes is shown in FIG. 3. Those rods are preferably made of metal so as to not absorb significant amounts of water. It also is preferable that the rods 46 have a polygonal cross-section, thus positioning the rods 46 in the center of the tube and decreasing the hydraulic diameter. Moreover, it is especially preferable that the rods 46 decrease the hydraulic diameter of the tubes to less than 50% of the hydraulic diameter of the tubes without the rods 46, for a 50% reduction will result in a twofold increase in the heat transfer coefficient (See Table 1).

The oil carries more heat than the oil and gas mixture. As a result, more heat must be transferred from it. This can be accomplished by using longer tubes 38 but that solution runs contrary to one of the primary objectives of this invention which is to minimize the size of the heat exchanger. Increasing the heat transfer coefficient of the tubes 38 by inserting rods 46, however, allows the heat carried by the oil to be transferred within the rows of tubes such that each tube 38 used to cool the oil is of the same length as each tube 40 used to cool the oil/gas mixture. Thus, there is a reduction in the size of the heat exchanger. Space could also be saved by inserting rods 46 into the row of tubes 40 wherein the oil/gas mixture is cooled but that would result in a deleterious pressure drop. A pressure drop in the gas is undesirable because it diminishes its cooling ability of the gas. Furthermore, the same heat exchangers can handle both fluids. Therefore, the present invention provides efficiency as well as versatility.

The extent of space saved by using the rod inserts can be illustrated by looking at two different heat exchangers. In one model used in the prior art to cool oil and an oil/gas mixture, ⅜" tubes were used and the tube pattern was 1.0"×0.75". The preferred embodiment of the present invention uses the same sized tubes and follows the same tube pattern. The old model employed steel tubes and steel fins wherein the fins were space 6 fins per inch. The preferred embodiment of the present invention, however, does not use steel tubes or fins. Cooper tubes and aluminum fins are used for copper and aluminum have higher thermal conductivity. The fins are spaced 8 fins per inch. The old model occupied a volume 438.75 in$^3$ whereas the preferred embodiment of the present invention occupies 212.63 in$^3$. All of the reduction in size is not attributable to the increase in the heat transfer coefficient caused by inserting the rods. Part of the increase is attributable to the use of materials of higher conductivity and to the change in fin spacing. The old model had 9 tubes for cooling the oil/gas mixture. The preferred embodiment, on the other hand, requires only 8 tubes. Since these tubes are the same size, the reduction is attributable to the use of different materials and the change in fin spacing. The reduction represents an 11% decrease in volume attributable to the materials and fin spacing.

Hence, to account for the reduction in volume attributable to use of rods, we must account for the 11%. If we multiply the old model volume by 89% we get an adjusted volume of 390.49 in$^3$. Based on this adjusted volume, the use of rods in the present invention results in a 45.55% reduction in volume. It should be noted that these figures are only approximate and certain assumptions are made in the calculations, nevertheless, they are valid support for the proposition that the use of the rod inserts results in a significant decrease in volume.

How the rods allow the heat exchanger to adequately cool the liquid oil can be seen by looking at the Nusselt number. Since there is a very low fluid velocity in the heat exchanger, the fluid flow is in the Laminar Fluid Regime which implies that the Nusselt Number is a constant. In particular $$NU = \frac{hD_h}{K} = \text{constant (1.0)}$$

where

Nu=Nusselt Number;

h=heat transfer coefficient;

$D_h$=hydraulic diameter;

K=thermal conductivity.

Since NU and K are constant in the above equation (1.0), the above equation implies that $$h\alpha \frac{1}{D_h} \text{ (2.0)}$$

From equation (2.0), it can be seen that to increase h we must decrease $D_h$ (0.15). How can $D_h$ *be decreased? Because,*

$$D_h = \frac{4A_c}{P_w} \text{ (3.0)}$$

where $D_h$=hydraulic diameter;

$A_c$=cross sectional flow area;

$P_w$=wetted perimeter $D_h$ can be decreased by adjusting $A_c$ and $P_w$. The present invention decreases $D_h$ by decreasing the cross-sectional flow area and increasing the wetted perimeter which, in turn, increases h. The extent of decrease in $D_h$ will be determined by the shape and size of the rods 46 inserted in the tubes. Different shapes and sizes affect both $A_c$ and $P_w$. Table 1 lists some sample results of performance with different shapes and sizes.

TABLE 1

| Tube Insert Type | $D_h$ TWI/$D_h$ TUBE Hydraulic Dia-Ratio | h TWI/h TUBE Heat Transfer Coefficient Ratio | $A_i$/A TUBE Flow Area Ratio |
|---|---|---|---|
| Rectangle (Smallest)[1] | 0.5 | 2.0 | 0.147 |
| Triangle (Smallest)[1] | 0.5 | 2.0 | 0.207 |
| Triangle (Snug)[2] | 0.321 | 3.1 | 0.413 |
| Square (Smallest)[1] | 0.5 | 2.0 | 0.230 |
| Square (Snug)[2] | 0.191 | 5.2 | 0.637 |

The same result could be accomplished by using smaller tubes, however, smaller tubes result in certain drawbacks. Tubes smaller than those used in the present invention (⅜") would be of nonstandard size and would require expensive custom fabrication. It would also be difficult to expand smaller tubes. Currently, expansion is required to create a snug fit between the tubes and conductive fins. The devices for expanding tubes are designed for larger tubes, thus, these devices could not be used on smaller tubes.

While the invention has been particularly shown and described with reference to preferred embodiments thereof, it will be understood by those skilled in the art that various changes in form and details may be made without departing from the spirit and scope of the invention as defined in the appended claims.

We claim:

1. A heat exchanger comprising:
(a) a set of tubes for carrying fluid wherein the fluid flows in the laminar flow regime;
(b) fins of high thermal conductivity material in thermal communication with the tubes;
(c) rods inserted to loosely fit within selective ones of the tubes to substantially decrease the hydraulic diameter thereof.

2. A heat exchanger as recited in claim 1 wherein the tubes are coupled to form a serpentine flow path.

3. A heat exchanger as recited in claim 2 wherein the tubes are situated in three parallel rows with the middle row of tubes staggered with respect to the other two rows.

4. A heat exchanger as recited in claim 3 wherein the rods are inserted in only two adjacent rows of tubes, and the third row contains no such rods.

5. A heat exchanger as recited in claim 1 wherein the fins are a stack of parallel plates containing holes aligned so as to allow the tubes to pass through each plate at the same respective position on each plate.

6. A heat exchanger as recited in claim 1 wherein the rods have a polygonal cross-section.

7. A heat exchanger as recited in claim 1 wherein the rods extend a substantial length of the corresponding tubes.

8. A heat exchanger as recited in claim 1 wherein the rods are metallic.

9. A heat exchanger as recited in claim 1 wherein the rods decrease the hydraulic diameters of the tubes to less than 50% of that of the tubes without such rods.

10. A cryogenic refrigeration system comprising:
(a) a compressor for compressing a fluid of refrigerant gas mixed with oil;
(b) a separator for separating a fluid of refrigerant gas mixed with oil from an oil fluid;
(c) a heat exchanger for cooling the fluid, the heat exchanger comprising:
(1) a set of tubes for carrying the gas mixed with oil fluid and oil fluid both having different thermal characteristics wherein both flow in the laminar flow regime;
(2) fins of high thermal conductivity material in thermal communication with the tubes; and
(3) rods inserted within the tubes to substantially decrease the hydraulic diameter; and
(d) a cryogenic refrigerator for expanding the gas.

11. A cryogenic refrigeration system as recited in claim 10 wherein the compressor and heat exchanger are coupled such that a mixture of gas and oil is directed to flow out of the compressor into the tubes of the heat exchanger not containing the rods.

12. A cryogenic refrigeration system as recited in claim 10 wherein the oil is directed out of an oil sump pump about the compressor into the rows of tubes of the heat exchanger containing rods.

13. A cryogenic refrigeration system as recited in claim 10 wherein the heat exchanger tubes are coupled to form a serpentine flow path.

14. A cryogenic refrigeration system as recited in claim 13 wherein the tubes of the heat exchanger are situated in three parallel rows with the middle row of tubes staggered with respect to the other two rows.

15. A cryogenic refrigeration system as recited in claim 14 wherein rods are inserted in only two rows of tubes of the heat exchanger, the third row containing no such rods.

16. A cryogenic refrigeration system as recited in claim 10 wherein the rods in the tubes of the heat exchanger have a polygonal cross-section.

17. A cryogenic refrigeration system as recited in claim 10 wherein the rods in the tubes extend a substantial length of the corresponding tubes.

18. A cryogenic refrigeration system as recited in claim 10 wherein the rods in the tubes of the heat exchanger decrease the hydraulic diameters of the tubes to less than 50% of that of the tubes without such rods.

19. A cryogenic refrigeration system as recited in claim 10 further comprising a filter for filtering oil from the output of the two rows of tubes of the heat exchanger containing the rods.

20. A cryogenic refrigeration system comprising:
(a) a compressor for compressing refrigerant gas mixed with oil;
(b) a separator for separating gas and oil;
(c) a heat exchanger for cooling the oil, the heat exchanger comprising:
(1) three parallel rows of tubes, the middle row being staggered with respect to the other two rows, which are coupled to form a serpentine laminar flow path;
(2) fins of high thermal conductivity material in thermal communication with the tubes realized as a stack of parallel plates containing holes aligned so as to allow the tubes to pass through each plate at the same respective position on each plate; and
(3) polygonal metallic rods that extend a substantial length of the two rows of tubes in which the rods are placed, the third row containing no such rods, which decrease the hydraulic diameter of the said two rows to less than 50% of the tubes without the rods; and
(d) a cryogenic refrigerator for expanding the gas; wherein a mixture of gas and oil is directed to flow out of the compressor into the tubes of the heat exchanger not containing rods and the oil is directed to flow out of the separator through two rows of tubes of the heat exchanger containing rods.

* * * * *